US009617104B2

(12) United States Patent
Hartung et al.

(10) Patent No.: US 9,617,104 B2
(45) Date of Patent: Apr. 11, 2017

(54) COMPENSATING DEVICE FOR FLUCTUATING CONVEYING SPEEDS OF A FIBROUS NONWOVEN

(71) Applicant: HI TECH TEXTILE HOLDING GMBH, Leonding (AT)

(72) Inventors: Steffen Hartung, Kissing (DE); Joachim Binnig, Jettingen-Scheppach (DE); Eberhard Häberle, Wildberg (DE); Andreas Meier, Affing (DE); Rudolf Kuhn, Neusäss (DE)

(73) Assignee: HI TECH TEXTILE HOLDING GMBH, Leonding (AT)

( * ) Notice: Subject to any disclaimer, the term of this patent is extended or adjusted under 35 U.S.C. 154(b) by 0 days.

(21) Appl. No.: 14/426,465

(22) PCT Filed: Sep. 6, 2013

(86) PCT No.: PCT/EP2013/068468
§ 371 (c)(1),
(2) Date: Mar. 6, 2015

(87) PCT Pub. No.: WO2014/037503
PCT Pub. Date: Mar. 13, 2014

(65) Prior Publication Data

US 2015/0218741 A1 Aug. 6, 2015

(30) Foreign Application Priority Data

Sep. 6, 2012 (DE) ..... 20 2012 103 402 U

(51) Int. Cl.
*B65H 20/30* (2006.01)
*D04H 1/74* (2006.01)
(Continued)

(52) U.S. Cl.
CPC ..... *B65H 20/30* (2013.01); *B65H 20/06* (2013.01); *B65H 2404/254* (2013.01);
(Continued)

(58) Field of Classification Search
CPC ..... B65H 20/06; B65H 23/10; B65H 23/105; B65H 23/1882; B65H 23/18;
(Continued)

(56) References Cited

U.S. PATENT DOCUMENTS 5,590,442 A 1/1997 Hirschek et al.
7,850,562 B2 * 12/2010 DeGroot ..... B65G 15/26 198/411
(Continued)

FOREIGN PATENT DOCUMENTS

DE 19 31 929 C3 8/1980
DE 198 11 497 A1 9/1999
(Continued)

*Primary Examiner* — Michael McCullough
(74) *Attorney, Agent, or Firm* — McGlew and Tuttle, P.C.

(57) ABSTRACT

A compensating device (1) for fluctuating transport speeds of a fiber nonwoven (3). The compensating device (1) has a buffer belt (2) driven in a loop with three or four or more deflection points (12, 13, 14, 15, 16) and with a variable sag (11) of the carrying run supporting the fiber nonwoven (3). The compensating device (1) further has an adjusting element (19) for adjusting the location of at least one deflecting point (15, 16).

32 Claims, 5 Drawing Sheets

(51) Int. Cl.

| | |
|---|---|
| *D01G 25/00* | (2006.01) |
| *B65H 20/06* | (2006.01) |
| *D04H 18/02* | (2012.01) |
| *D04H 18/04* | (2012.01) |

(52) U.S. Cl.
CPC ..... *B65H 2404/2613* (2013.01); *D01G 25/00* (2013.01); *D04H 1/74* (2013.01); *D04H 18/02* (2013.01); *D04H 18/04* (2013.01)

(58) Field of Classification Search
CPC ..... B65H 23/1888; B65H 2404/254; B65H 2404/255; B65H 2404/2611; B65H 2404/2613; B65H 2404/2615; B65H 2301/44322; B65H 20/30; B65G 15/26
USPC ..... 198/813, 812, 588, 594
See application file for complete search history.

(56) References Cited

U.S. PATENT DOCUMENTS

| | | | | |
|---|---|---|---|---|
| 8,365,370 | B2 * | 2/2013 | Leger | D01G 21/00 19/161.1 |
| 8,879,931 | B2 * | 11/2014 | Kawakami | G03G 15/1615 399/162 |
| 2010/0084248 | A1 * | 4/2010 | Leger | D01G 21/00 198/617 |
| 2013/0016983 | A1 * | 1/2013 | Kawakami | G03G 15/1615 399/38 |

FOREIGN PATENT DOCUMENTS

| | | |
|---|---|---|
| EP | 0 609 907 A2 | 8/1994 |
| EP | 2 175 056 A1 | 4/2010 |
| EP | 1 643 022 B1 | 9/2010 |

* cited by examiner

COMPENSATING DEVICE FOR FLUCTUATING CONVEYING SPEEDS OF A FIBROUS NONWOVEN

CROSS REFERENCE TO RELATED APPLICATIONS

This application is a United States National Phase Application of International Application PCT/EP2013/068468 filed Sep. 6, 2013 and claims the benefit of priority under 35 U.S.C. §119 of German Application DE 20 2012 103 402.6 filed Sep. 6, 2012, the entire contents of which are incorporated herein by reference.

FIELD OF THE INVENTION

The present invention pertains to a compensating device for fluctuating conveying speeds of a fibrous nonwoven, wherein the compensating device has a circulating driven storage belt with a plurality of deflection points and a variable slack of an upper run carrying the fibrous nonwoven.

BACKGROUND OF THE INVENTION

Such a compensating device for a fibrous nonwoven is known from EP 1 643 022 B1. It is arranged between a nonwoven laying device and a needle machine and has an endless, rotatingly driven storage belt with two deflecting rollers. The fibrous nonwoven is arranged on the upper run of the storage belt and stored temporarily in a variable slack of the upper run as needed. Differences in speed between the nonwoven laying device and the needle machine can be compensated hereby. The amount of the slack and the size of the nonwoven storage device is determined by differences in the speed of the drives at the deflecting rollers.

SUMMARY OF THE INVENTION

An object of the present invention is to provide an improved compensation technique for fluctuating conveying speeds of a fibrous nonwoven.

According to the invention, a compensating device, for fluctuating conveying speeds of a fibrous nonwoven, has a circulating driven storage belt. The circulating driven storage belt has a plurality of deflection points and a variable slack of its upper run carrying the fibrous nonwoven. The storage belt has three or four or more deflection points for stretching the storage belt. The compensating device has an adjusting device shifting at least one deflection point.

The compensation technique according to the invention, i.e., the compensating device and the compensation method, has the advantage of offering an improved possibility for controlling and affecting the slack and the storage capacity of the storage belt.

By shifting a deflection point and by detecting the path of adjustment, the slack at the upper run carrying the nonwoven and thus the size of the nonwoven storage device can be calculated, set and controlled as well as regulated especially reliably and accurately.

The compensating device being claimed has, further, the advantage of having increased storage capacity compared to the state of the art. It is especially advantageous for this if a lower run of the endless storage belt is tightened via four or more deflection points in a belt polygon, especially a belt quadrangle or belt pentagon, far downwards, as a result of which the upper run carrying the nonwoven can lower far downwards to increase the slack. The change in slack may be greater than in the state of the art. In addition, it is possible to work with a steadily present slack of the belt run carrying the nonwoven, where the amount of the slack varies, which leads to advantages in terms of reliable guiding of the nonwoven and adhesion of the nonwoven on the storage belt. In particular, great accelerations at right angles to the direction in which the storage belt extends can be avoided. A belt quadrangle or belt pentagon is, besides, advantageous for the reliable and accurate detection of the path of adjustment of a deflection point and for the precision of control and regulation.

There are various possibilities for controlling or regulating the amount of the slack and the storage capacity of the storage belt.

The amount of the slack can be controlled or regulated by differences in the speed of the drives on the discharge side and the feed side of the upper run with support by a passive adjusting device, which tightens and tensions the other, especially lower area of the belt run by shifting at least one deflection point, especially a deflecting roller.

The amount of the slack no longer depends necessarily directly on differences in the speed of the drives on the discharge side and feed side of the upper run. The amount of the variable slack and the storage capacity determined thereby may also be affected and controlled as well as regulated by an active adjusting device and a defined shifting of at least one deflection point, especially a deflecting roller. The length of another belt run is increased or reduced now and the belt run carrying the nonwoven, especially the upper run, is tightened or loosened now. The slack is reduced or increased by this change in the position of the belt run carrying the nonwoven.

Further, a positive-locking connection between the storage belt and at least one circulating driven deflecting roller is advantageous for the different embodiments. Specifically avoiding slipping in at least some areas is favorable for defined motions of the belt in case of changes in slack and for the accuracy of the control and regulation.

The compensation technique being claimed is suitable for high nonwoven conveying speeds and for high-speed devices arranged downstream. The increase in the storage and compensation capability as well as the improvement of the quality of control and regulation have especially favorable effects for this. The discharge speed of a nonwoven laying device or of another upstream device may equal 40 m/minute or more. The downstream device may be, e.g., a strengthening device or another device for further processing the nonwoven. A strengthening device may be designed, e.g., as a needle machine, thermobonding device or as an especially high-speed water jet strengthening device (so-called spunlace). On the whole, the speed level of a fiber plant as well as the components thereof and hence also the performance capacity and the economy can be significantly increased thereby.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
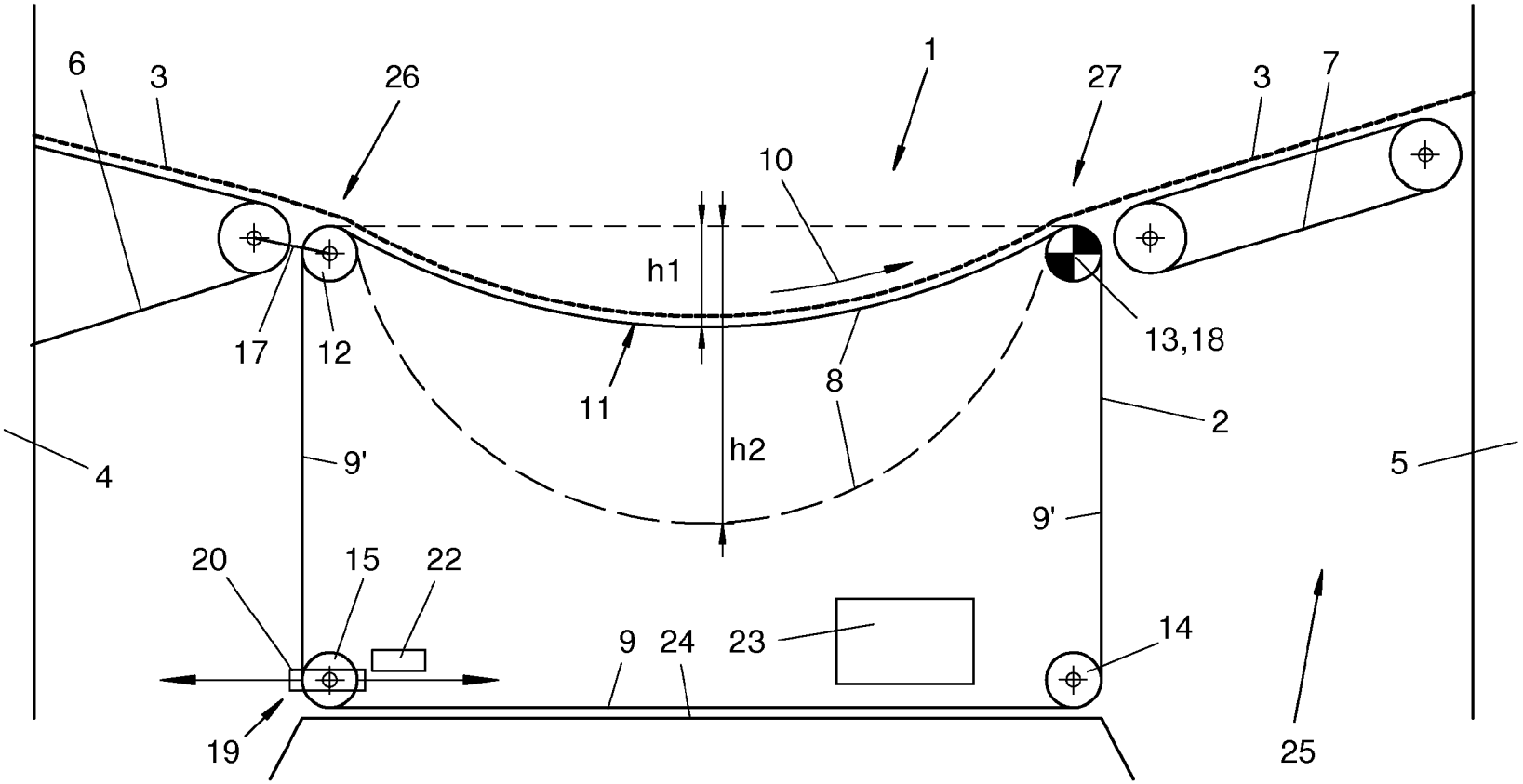
FIG. 1 is a schematic side view showing a first variant of a compensating device.

The present invention pertains to a compensating device (1) for fluctuating conveying speeds of a fibrous nonwoven (3), especially for compensating differences in speed on the feed side and the discharge side (26, 27) of the compensating device (1). The present invention pertains, further, to a method for compensating such fluctuating conveying speeds.

The compensating device (1) shown in different variants in FIGS. 1 through 5 is arranged between an upstream device (4), e.g., a nonwoven laying device, and a downstream device (5), e.g., a strengthening device (5), especially a needle machine, and transports in the conveying direction a multilayer nonwoven (3) arriving from the nonwoven laying device (4) via a laydown belt (6) to the strengthening device (5), optionally via a feed belt (7) arranged upstream. The compensating device (1) now compensates the fluctuating conveying speeds of the nonwoven laying device (4) and releases in its turn the nonwoven (3) to the strengthening device (5) at an adjustable and essentially constant speed.

The nonwoven (3) is a fibrous nonwoven or nonwoven product. It consists of textile fibers, especially synthetic fibers, and is formed in the nonwoven laying device (4) by folding over and taking off a one-layer or multilayer formed fabric. The nonwoven (3) is multilayered.

The compensating device (1) has an endless storage belt (2) circulating in a closed loop, which is stretched into a belt polygon, e.g., a belt quadrangle or belt pentagon by means of three, four, five or more deflection points (12, 13, 14, 15, 16). The deflection points (12, 13, 14, 15, 16) may be designed as rotatable, roller-like deflecting rollers.

The upper run (8) of the storage belt (2) is located between two upper deflecting rollers (12, 13). The lower run (9) is defined between two lower deflecting rollers (14, 15) in the variants according to FIGS. 1 through 3. Side runs (9') of the storage belt (2) are located between the upper and lower deflecting rollers (12, 13, 14, 15).

The upper run (8) of the storage belt (2) receives the nonwoven (3) and transports it in the conveying direction (10). This is also the circulating conveying direction of the storage belt (2). The upper run (8) is guided over two upper deflecting rollers (12, 13) and forms between them a steady slack (11) with variable height (h1, h2). The respective slack height (h1, h2) is measured from the lower vertex) of the corresponding belt loop or slack (11) formed hereby to the upper, common tangent to the deflecting rollers (12, 13), which corresponds to the theoretical position of the upper run in the tightened position. The nonwoven (3) preferably lies open and without coverage on the upper run (8). It may be covered as an alternative.

The upper run (8) has a permanent slack with a minimum height (h1) and a maximum height (h2) indicated by broken line. The greater the height of the slack (11), the longer is the upper run (8) and the more nonwoven (3) can be taken up and stored. The slack height (h) determines the storage capacity of the compensating device (1).

The lower deflection points (14, 15, 16) are spaced from the upper deflection points (12, 13) in height to the extent that they tighten the lower run (9) of the storage belt (2) far downwards and space it from the upper run (8) by more than the maximum height (h2) of the slack (11).

The laydown belt (6) of the nonwoven laying device (4) transports the nonwoven (3) at a fluctuating conveying speed. This may correspond to the velocity profile of a lower main carriage or laying carriage of the nonwoven laying device (4), which moves transversely to and fro over the laydown belt (6) and brakes at the edges of the laying width, stops and accelerates again. The speed of the laying carriage may fluctuate, in addition, when the nonwoven laying device (4) lays a nonwoven (3) with an area weight varying over the laying width and possibly over the running length on the discharge belt (so-called profiling). These fluctuations in speed are reflected in the conveying speed of the laydown belt (6) and the speed at which the nonwoven (3) is fed on the feed side (26) of the compensating device (1).

The nonwoven (3) is discharged to the feed belt (7) or to the strengthening device (5) at a controllable or regulatable speed on the discharge side (27). The discharge speed may be constant or fluctuate within limits around a mean value, which is sent as a guideline value to the downstream device (5), e.g., a strengthening device.

The differences in speed between the feed side and the discharge side (26, 27) are compensated in the slack (11) (11) with the variable heights (h1, h2) and the nonwoven (3) is stored temporarily. The nonwoven storage device formed by the variable slack heights (h1, h2) can be controlled or regulated.

The discharge speed of the compensating device (1) to the strengthening device (5) is between the maximum and minimum nonwoven discharge speeds of the nonwoven laying device (4) on the feed side (26) and is preferably such that the nonwoven storage device formed in the slack (11) of the upper run (8) during a laying cycle of the nonwoven laying device (4), e.g., a travel cycle of the laying carriage with a forward travel and a reverse travel, can be filled and emptied again.

The storage belt (2) has one or more drives or belt drives (17, 18) for a circulating motion. One drive (18) is arranged at the discharge-side (27) upper deflection point or deflecting roller (13). The speed of circulation of the storage belt (2) present on the discharge side (27) over the deflecting roller (13) can be adapted to the feed speed of the downstream device (5), especially the strengthening device or of the feed belt (7). To keep the nonwoven (3) under a steady, slight tension, said feed speed may be somewhat higher than said discharge or circulation speed.

A drive (17) may likewise be arranged on the feed side (26) of the compensating device (1) at the upper deflection point or deflecting roller (12) located there. The drives (17, 18) may be controllable and optionally regulatable drives, which have a suitable motor drive device, e.g., electric motor, especially servomotors, and which are connected with a control (23) of the compensating device (1). The feed-side drive (17) may be coupled here with the speed of discharge of the laydown belt (6) and have a somewhat higher speed level for the above-mentioned pulling of the nonwoven. The coupling may also be embodied by means of signal technology. One or both of the belt drives (17, 18) may, in addition, be regulatable, in which case corresponding sensors, e.g., speed transducers, are present at a suitable location.

As an alternative, the drive (17) may be formed by a mechanical drive coupling between the feed-side deflecting roller (12) and the adjacent deflecting roller of the laydown belt (6). In another variant, a separate drive of the deflecting roller (12) may be eliminated, in which case this is carried and rotated via a circulating motion of the storage belt.

The non-driven deflecting rollers (14, 15, 16) or rollers may be mounted in a freely rotatable manner. They may have a cylindrical jacket that is smooth on the outside. The driven deflecting rollers (12, 13) may likewise have a cylindrical jacket that is smooth on the outside. They may transmit the driving force to the storage belt (2) by frictional engagement. This storage belt may likewise have a flat surface at least on the support side.

Figure 5:
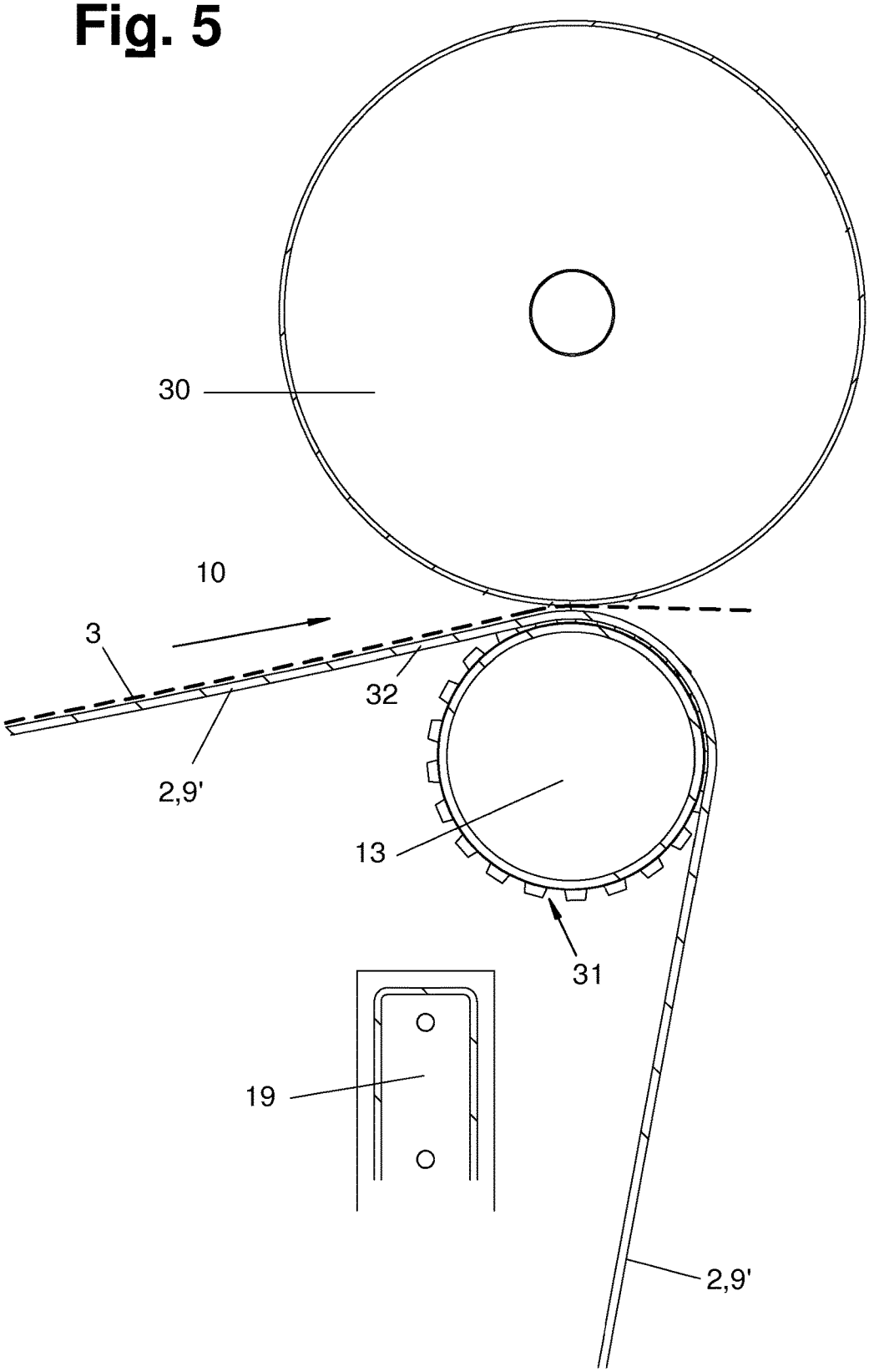
FIG. 5 is a view showing a detail of the design of the drive and belt.

One or more driven deflecting roller(s) (12, 13) may have, as an alternative, a cylindrical jacket (31), which is profiled on the outside, and drive the storage belt (2) in a positive-locking manner. The profiling (31) may be, e.g., a circumferential tooth or wave profile. The storage belt (2) may have for this, at least on the support side, an uneven surface with a fitting counterprofiling (32). It may be designed, e.g., as a lattice feed table. Further, a pressing roller (30) for clamping the nonwoven (3) being discharged may be arranged above the discharge-side (27) upper deflecting roller (13). It may be driven rotatingly synchronously with the deflecting roller (13). It may also be arranged in a vertically adjustable manner. FIG. 5 shows such a configuration.

The motors used as drives (17, 18), especially electric motors, may likewise have different designs and be controlled or regulated in different manners. This may be, e.g., speed regulation or torque regulation or a combination of the two with the possibility of switchover. Further, a drive (17, 18) may have a braking motor, which has an integrated brake engaging on stopping, especially a mechanical brake. It also holds the storage belt (2) in the stretched form with slack (11) after the belt drive (17, 18) has been switched off.

The height (h1, h2) of the slack (11) on the upper run (8) of the storage belt (2) and the size of the nonwoven storage device formed thereby may be controlled or regulated by a controlled or regulated shifting of at least one deflection point (14, 15, 16) in the area of the lower run (9) or side run (9'). As an alternative, or in addition, the height (h1, h2) of the slack (11) and of the nonwoven storage device formed thereby may be controlled by differences in the speeds of the drives (17, 18).

If the slack (11) is controlled or regulated by a controlled or regulated shifting of at least one deflection point (14, 15, 16), the length of the belt is changed in the area of the lower run (9) or side run (9'), which leads to a compensating change in the length of the upper run (8) and hence in the slack height (h1, h2) of the upper run (8). An increase in the length of the lower run (9) or side run (9') brings about a reduction in the length of the upper run (8) as well as a reduction of the slack height (h) and a reduction in the size of the nonwoven storage device. Conversely, a decrease in the length of the lower run (9) or side run (9') leads to an increase in the length of the upper run (8) as well as to an increase in the slack height (h) and in the size of the nonwoven storage device. Part of the storage belt length is now shifted between the upper run (8) and the lower or side run (9, 9').

This shifting of the belt can be compensated by adapting the speed of rotation and a possibly elastic characteristic of one or both belt drive(s) (17, 18) at the upper run (8). The change in the speed of rotation may correlate with the varying discharge speed of the nonwoven laying device (4). If differences develop, said elastic compensation can take place.

An adjusting device (19), which has a corresponding guide for the adjusting motion of the deflection point or deflecting roller (14, 15, 16), is provided for changing the position of a deflection point or deflecting roller (14, 15, 16). The adjusting device (19) may have an active or passive design. In the active variant, it has an adjusting drive (20, 21) for the adjusting motion of the deflection point or deflecting roller, which drive may have various designs. In the passive variant, it has a tensioner (28, 29) for tightening the lower belt run area.

The adjusting device (19) may also ensure locking of the deflection point or deflecting roller (14, 15, 16), when needed, in an operating or tightened position by means of the adjusting drive (20, 21) or in another manner, e.g., by means of a clamping device at the guide. This may happen, e.g., when the compensating device (1) is switched off, in order to fix the slack (11) and make it available on switching back on. The adjusting device (19), especially its adjusting drive (20, 21) or the locking or clamping device is connected with the control (23).

Further, a detection device (22) may also be present for the path of adjustment and optionally the speed of adjustment or acceleration of the movable deflection point or deflecting roller (14, 15, 16). It may likewise be connected with the control (23). The distance from the other lower deflection point or deflecting roller or to the other lower deflection points or deflecting rollers and hence the length of the lower run (9) is changed with the adjusting motion of the deflection point or deflecting roller (14, 15, 16). The length of the upper run (8) and the height (h1, h2) of the slack (11) thereof change correspondingly.

The change in height and the change in the size of the nonwoven storage device can therefore be determined from the value detected by the detection device (22), especially the path of adjustment. On the other hand, the control (23) may generate an optionally varying or dynamic set point for the path of adjustment for regulating the slack height (h) and the size of the nonwoven storage device in adaptation to the varying nonwoven discharge by the nonwoven laying device (4), after which the regulation of the belt drive or belt drives (17, 18) and/or of the adjusting drive (20, 21) takes place.

For example, the feed-side (26) lower deflection point or deflecting roller (15) is specifically adjusted in the exemplary embodiment according to FIG. 1 to change the slack height (h).

Both lower deflection points or deflecting rollers (14, 15) are located in the starting position vertically under the respective corresponding upper deflection point or deflecting roller (12, 13) in the embodiment shown in FIG. 1, so that the two side runs (9') of the storage belt (2) have an essentially vertical orientation. The belt is deflected by about 90° or more at the deflection points or deflecting rollers (12, 13, 14, 15).

The right-hand lower deflection point or deflecting roller (14) may be mounted stationarily, in which case only the position of the other deflection point or deflecting roller (15) is changed by means of an active adjusting device. As an alternative, both deflecting rollers (14, 15) may be movable and have adjusting devices, or only the position of the discharge-side (27) lower deflection point or deflecting roller (14) is changed by an adjusting device, in which case the feed-side deflection point or deflecting roller (15) is mounted stationarily.

In the embodiment shown in FIG. 1, the adjusting motion is a linear motion, which is directed horizontally or obliquely. The adjusting drive (20) is correspondingly designed as a linear drive, e.g., as an electric motor-driven spindle drive, toothed rack drive, circulating belt drive, controllable cylinder or the like. The adjusting driver (20) is connected with the control (23) and can be controlled or regulated by means of the detection device (22) to bring about the desired slack height (h).

As is shown in FIG. 1, a support (24) may be arranged under the, e.g., horizontal area of the lower run (9), and said support (24) prevents sagging of this belt run area and contributes to a defined length of the lower run. The support (24) is shown in the drawing as a flat support surface running in parallel to the lower run (9). As an alternative, the support may be designed as a tensioning device.

The discharge-side belt drive (18) is the master drive, which is regulated, e.g., to a constant discharge speed and speed of rotation. The feed-side drive (17) is formed by a mechanical drive coupling between the feed-side deflecting roller (12) and the adjacent deflecting roller of the discharge belt (6). The belt shifting caused by the adjusting drive (20) between the upper run and the lower run correlates, as a rule, with the speed fluctuations transmitted by coupling at the laydown belt (6), so that an elastic compensation is not necessary.

Figure 2:
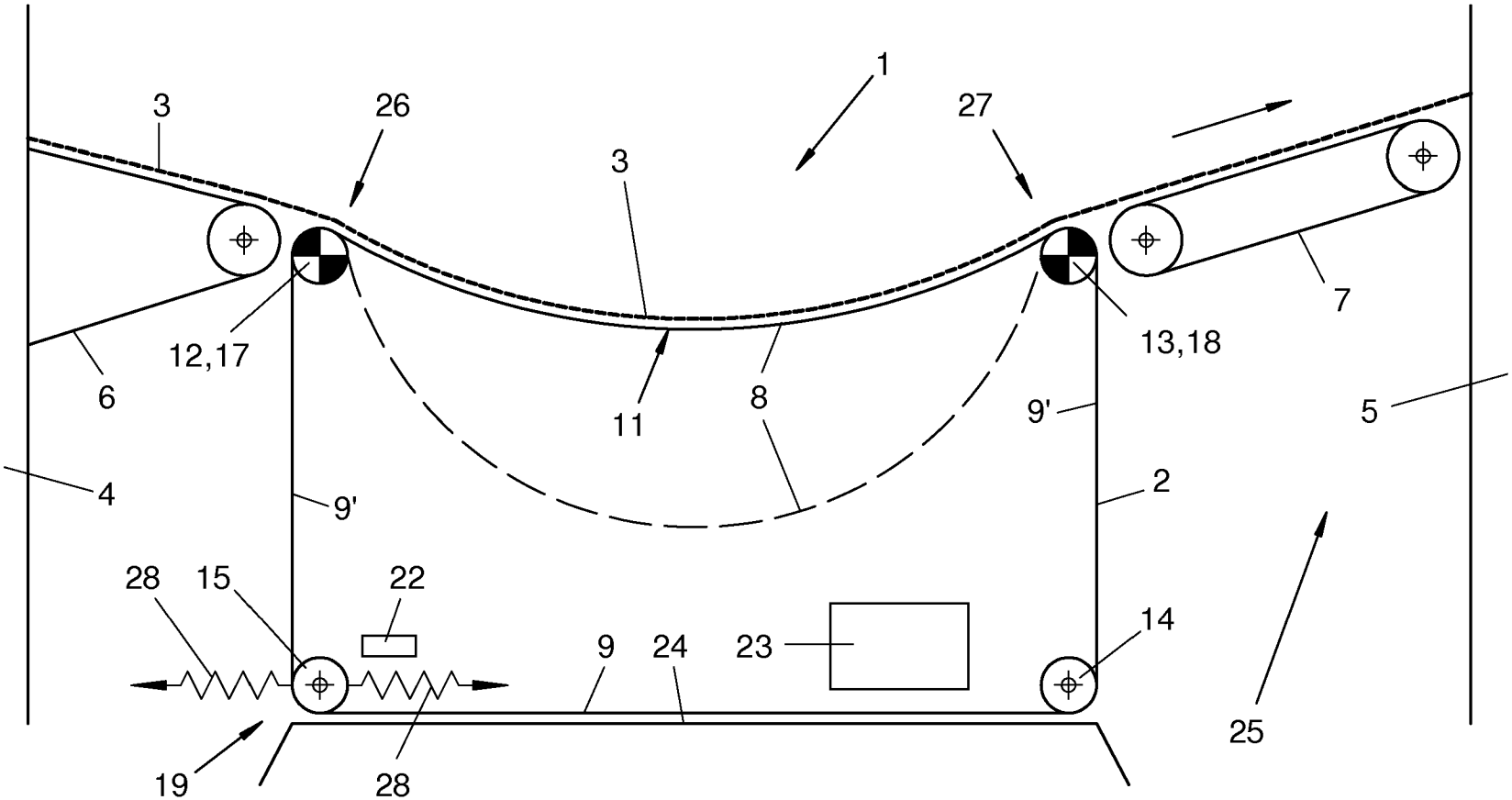
FIG. 2 is a schematic side view showing a variant of the compensating device according to FIG. 1.

FIG. 2 shows a variant of the compensating device (1), which differs from the embodiment according to FIG. 1 by the adjusting device (19) and the feed-side drive (17). A separate, controllable or regulatable belt drive (17), which is coupled with the feed device (6) in terms of signal technology, e.g., an electric motor, is arranged at the feed-side (26) upper deflecting roller (12) in this exemplary embodiment. The other belt drive (18) is the master drive and is regulated to a constant speed of rotation. The adjusting device (19) is passive in this case and tensions the lower run (9) by means of springs (28), which keep the belt polygon formed tensioned and in shape even in case of fluctuations in the drive speed of the upper drive (17).

The slack (11) and the size of the nonwoven storage device are controlled here by the differences in the speeds of the belt drives (17, 18). If a detection device (22), with which the slack height (h) can be determined, is arranged at the adjusting device (19), regulation of the slack (11) is possible as well. The coupling of the belt drive (17) with the feed device or the laydown belt (6) may be optionally eliminated for this and the speed of rotation of the motor can be preset and regulated by the control (23).

Figure 3:
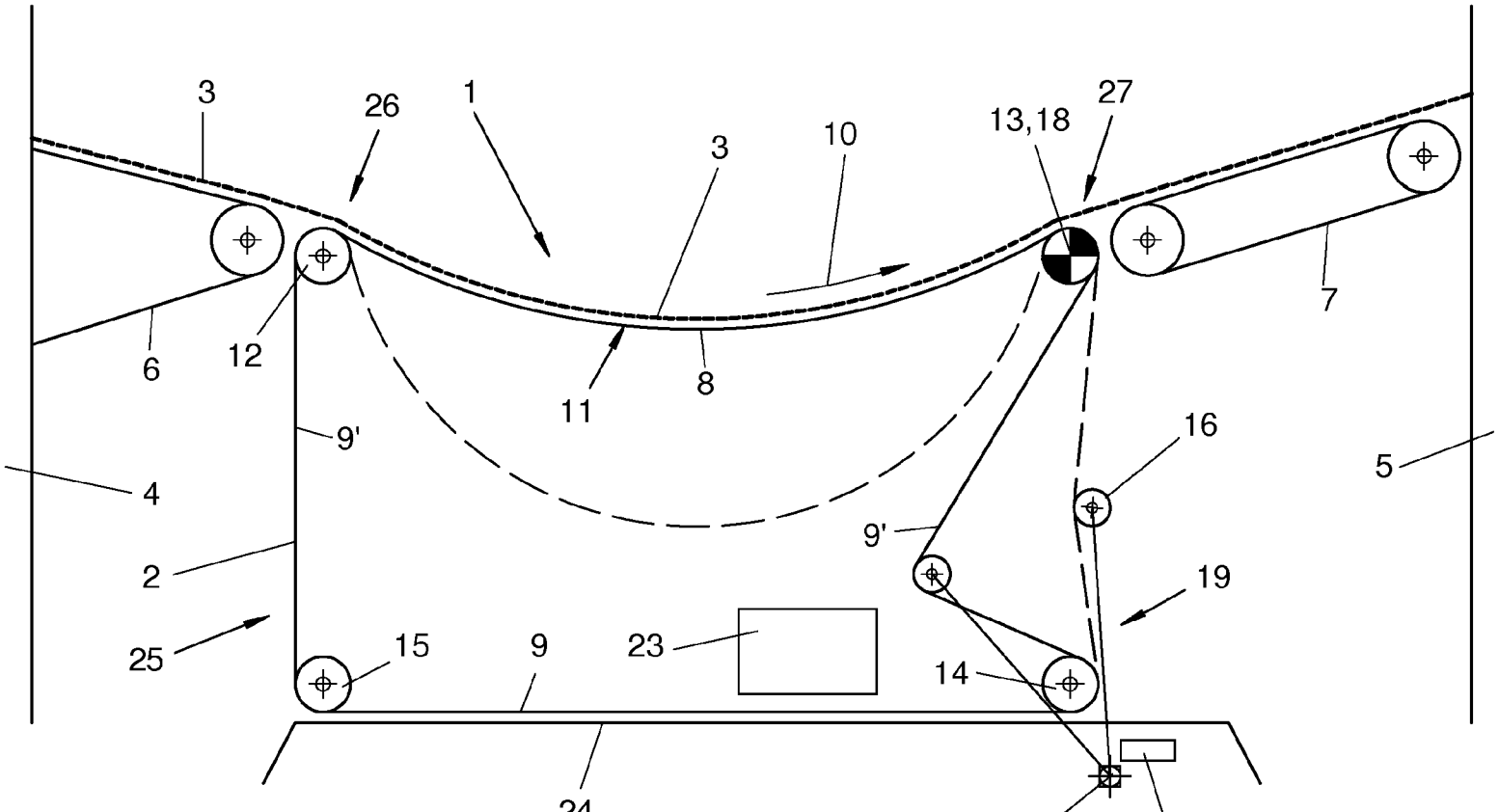
FIG. 3 is a schematic side view showing another variant of the compensating device according to FIG. 1.

For example, the upper, feed-side deflecting roller (12) is not driven in the variant according to FIG. 3. As an alternative, it may have a belt drive (17) of the above-described type. The adjusting device (19) is arranged in FIG. 3 at the side run (9') between the discharge-side (27) upper and lower deflecting rollers (13, 18) and forms a tensioning device acting in the middle area of the side run (9') with an additional deflection point or deflecting roller (16). This roller is arranged, e.g., on a pivot arm on the end side and forms a tensioning roller, with which the length of the side run (9') is changed according to FIG. 3, and the height (h) of the slack (11) of the upper run (8) is changed accordingly. The adjustment can be detected with a detection device (22) and used for the purposes of the above-described control and regulation. The storage belt (2) is stretched in a belt pentagon.

If two belt drives (17, 18) are used, the discharge-side belt drive (18) may optionally respond elastically for compensating the belt shiftings between the upper run (8) and the other, especially lower belt run area (9, 9') and its speed of rotation may fluctuate.

The adjusting drive (21) is designed in this embodiment as a pivoting drive, which pivots the tensioning roller (16). As an alternative, the adjusting motion may be linear, in which case the adjusting drive (21) is correspondingly converted into a linear drive. The adjusting device (19) may also be arranged, as an alternative, at the feed-side (26) side run (9').

Figure 4:
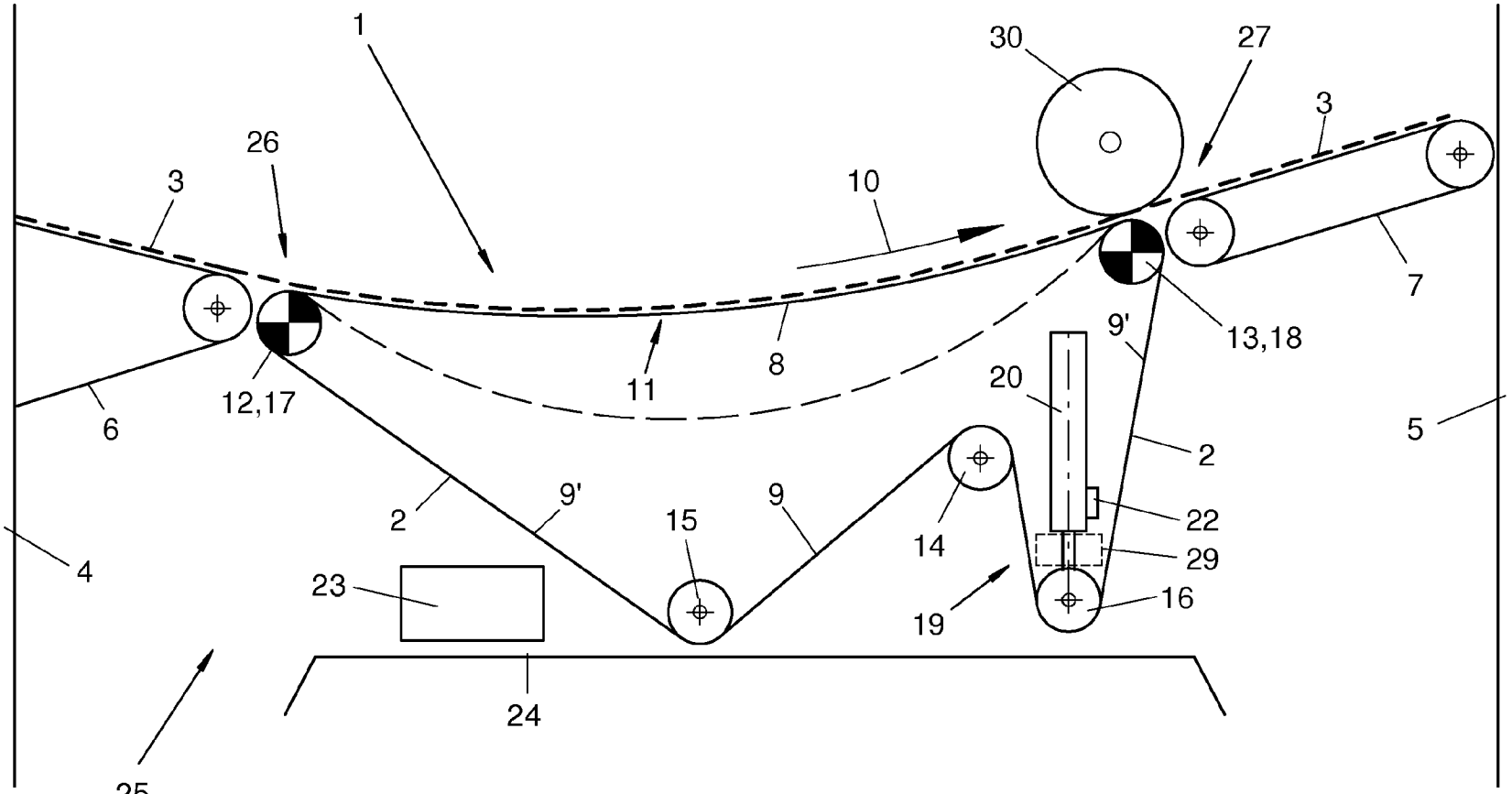
FIG. 4 is a schematic side view showing another variant of the compensating device according to FIG. 1.

FIG. 4 shows a variant of the compensating device (1) with a different arrangement of the lower deflecting rollers (14, 15, 16) and a different design of the lower belt run area as well as with a different adjusting device (19). Furthermore, a positive-locking drive of the storage belt (2) is provided here. In addition, the pressing roller (30) mentioned at the beginning is arranged above the upper discharge-side (27) deflecting roller (13).

The storage belt (2) is likewise stretched here in a belt pentagon. The feed-side (26) side run (9') extends from the deflecting roller (12) obliquely downward to a lower deflecting roller (15). The discharge-side (27) side run (9') extends from the upper deflecting roller (13) vertically or obliquely downward to a lower deflecting roller (16). The lower run (9) is led between the deflecting rollers (15, 16) over a further deflecting roller (14) arranged above and is stretched in a triangle.

The compensating device (1) has electric motor belt drives (17, 18), which are preferably speed-controlled drives. The adjusting device (19) may optionally have an active or passive design and acts on the lower belt run area at the site of the transition between the lower run and the side run (9, 9'). It acts from the top preferably vertically on the deflecting roller (16), which forms on the discharge side (27) a tensioning loop in the lower belt run area.

In the active variant of the adjusting device (19), the adjusting drive (20) is preferably designed as a linear drive of the type described at the beginning. The deflecting roller (16) is led vertically adjustably in a guide. The adjusting drive (20) is eliminated or switched off in the passive variant of the adjusting device (19). The deflecting roller (16) is now pressed downward by the force of gravity or weight (29) and tensions the belt loop and the lower run as well as the side run (9, 9'). The weight (29) may be formed by the own weight of the guided deflecting roller (16) or optionally also by an additional weight. The adjusting device (19) has, besides, a detection device (22) of the above-described type.

The adjacent deflecting roller (14) is arranged above the other deflecting roller (15), so that the lower run (9) has an additional tensioning loop in its triangular course.

For positive-locking belt transport, the upper deflecting rollers (12, 13) have a profiling (31) on the outer circumference, which profiling may be designed, e.g., as a tooth profile or wave profile extending along the roller axis. The storage belt (2) has a fitting counterprofile (32) and is designed, e.g., as a lattice feed table. As an alternative, it may also be designed as a toothed belt or the like with an optionally one-sided profiling (32). At least one of the drive motors (17, 18) is preferably designed as a braking motor.

The compensating device (1) may be operated in different ways. In case of an active adjusting device (19) with an adjusting drive (20) as well as with a detection device (22), the slack height (h) is controlled or regulated by means of this. This takes place at the discharge-side (27) area of the lower and/or side run (9, 9'). The discharge-side belt drive (18) may be regulated to a fixed speed of rotation and discharge speed, and the belt shifting between the upper run (8) and the lower or side run (9, 9') takes place via the feed side (26) and the speed adaptation of the drive (17), which takes place there. The belt shifting may be compensated, on the other hand, by means of the elasticity of the discharge-side belt drive (18), and the speed of rotation of this drive can be adapted correspondingly. The speed regulation may be switched off for this. It is possible to switch over to torque regulation or optionally to a torque limitation.

In case of a passive adjusting device (19), the slack (h) is controlled by the preferably speed-regulated belt drives (17, 18), and the weight (29) tightens the lower and/or side run (9, 9') and keeps it under tension. A positive-locking drive transmission is advantageous for these variants and ensures high precision of control despite the tightening of the lower and/or side run (9, 9') in the vicinity of the discharge-side (27) belt drive (18).

In another variation to FIG. 4, the passive or active adjusting drive (19) shown may also be moved to another location and arranged on the feed side (26).

The drives (17, 18, 20, 21) are connected with said control (23). The one or more detection devices (22) are also connected with the control (23). The control (23) may be a common control and may be associated with the compensating device (1). As an alternative, it may be integrated in another existing control, e.g., in a higher-level plant control.

The compensating device (1) may be part of a plant (25) for processing fibers in the embodiments shown. This plant (25), indicated schematically, may have the feed-side and discharge-side plant components (4, 5) indicated in the drawings. These may have the above-mentioned design as a nonwoven laying device (4) and strengthening device (5), especially needle machine or water jet strengthening device (so-called spunlace). However, they may also have any other design as desired.

The plant (25) may comprise further plant components, e.g., a device for fiber processing and for forming a one-layer or multilayer formed fabric, which is fed to the nonwoven laying device (4). Such a device may be designed as a carder. Furthermore, a higher-level plant control as well as a profiling device for the nonwoven (3), optionally in conjunction with a measuring and regulating device, may be present. The compensating device (1) may also be arranged, for example, at another location of the plant (25), e.g., in front of the nonwoven laying device (4) in the direction of run of the formed fabric.

Various variants of the embodiments shown and described are possible. On the one hand, the features of the exemplary embodiments may be combined or replaced with one another as desired. Further, it is possible to equip the deflection points (12, 13, 14, 15, 16) with other sliding or rolling devices. The number and arrangement of the adjusting device (19) may vary. The storage belt (2) may be stretched out by five, six or more deflection points to a belt pentagon, belt hexagon or the like. A triangular arrangement with three deflection points is also possible, in which case, e.g., the lower deflection point for the lower run can be adjusted in height with an active or passive adjusting device. As an alternative, the locations of other deflection points or, in another variant, also of a plurality of deflection points (12, 13, 14, 15, 16) may also be changed to compensate the fluctuating nonwoven conveying speeds.

While specific embodiments of the invention have been shown and described in detail to illustrate the application of the principles of the invention, it will be understood that the invention may be embodied otherwise without departing from such principles.

The invention claimed is:

1. A compensating device for fluctuating conveying speeds of a fibrous nonwoven, the compensating device comprising:

an endless circulating driven storage belt;

a plurality of deflection points comprising two spaced apart fixed upper run deflection points defining a variable slack circulating driven belt upper run carrying the fibrous nonwoven, the plurality of deflection points further comprising two or more compensating deflection points defining taut belt runs between one of the compensating deflection points and one of the upper run deflection points, between another of the compensating deflection points and another of the upper run deflection points and between compensating deflection points; and an adjusting device shifting at least one of the compensating deflection points for moving one of the compensating deflection points to change a spacing between two of the compensating deflection points, to change an amount of belt comprised by the taut belt runs and to compensate the variable slack circulating driven belt upper run of the storage belt.

2. A compensating device in accordance with claim 1, wherein the storage belt has five or more deflection points.

3. A compensating device in accordance with claim 1, wherein the adjusting device is configured, cooperating with the one of the compensating deflection points, to tighten or slacken the slack of the upper run.

4. A compensating device in accordance with claim 3, the compensating deflection points comprise non-driven deflecting rollers having a cylindrical jacket that is smooth on an outside.

5. A compensating device in accordance with claim 1, wherein:

the circulating driven storage belt has another belt run area; and the adjusting device has a controllable adjusting drive for moving one of the deflection points at the other belt run area.

6. A compensating device in accordance with claim 5, wherein the adjusting device has a detection device for detecting the path of adjustment of the movable deflection point.

7. A compensating device in accordance with claim 6, further comprising a control and one or more circulating drives driving the storage belt in a circulating motion wherein the detection device, the one or more circulating drives and the adjusting drive are connected with the control of the compensating device.

8. A compensating device in accordance with claim 1, wherein:

the taut belt runs comprise a lower run and side runs; and the adjusting device has a tensioner comprising a spring or a weight maintaining a taut belt, belt run, state for the lower run and the side runs.

9. A compensating device in accordance with claim 1, wherein the adjusting drive is configured as a linear drive or as a pivoting drive.

10. A compensating device in accordance with claim 1, wherein:

the fibrous nonwoven is taken up on the upper run of the storage belt; and a plurality of the deflection points tighten a lower run of the storage belt downwards and space the storage belt from the upper run by more than a maximum height of the slack.

11. A compensating device in accordance with claim 1, wherein four or five of the deflection points stretch a belt quadrangle or belt pentagon.

12. A compensating device in accordance with claim 1, wherein the one of the compensating deflection points is arranged at one end of a lower run of the taut belt runs.

13. A compensating device in accordance with claim 1, wherein the one of the compensating deflection points is arranged at a middle area of a lower or lateral belt run of the taut belt runs and is configured as a tensioning device.

14. A compensating device in accordance with claim 1, wherein the deflection points are configured as sliding or rolling devices.

15. A compensating device in accordance with claim 1, wherein the storage belt has at least one drive for driving the storage belt in a circulating motion.

16. A compensating device in accordance with claim 1, wherein a drive is associated with one of the deflection points comprised of a deflecting roller.

17. A compensating device in accordance with claim 1 in combination with an upstream nonwoven laying device, wherein the compensating device is operatively connected, on the feed side, with the upstream nonwoven laying device.

18. A compensating device in accordance with claim 1 in combination with a downstream strengthening device comprising a needle machine or a water jet strengthening device, wherein the compensating device is operatively connected, on the discharge side, with the downstream strengthening device.

19. A compensating device in accordance with claim 1, wherein a control is connected with a control of a nonwoven laying device and/or of a strengthening device and/or with a higher-level plant control.

20. A compensating device in accordance with claim 1, wherein the compensating device has a support for the lower run of the storage belt.

21. A compensating device in accordance with claim 1, wherein the adjusting device is configured, cooperating with the at least one of the deflection points, to control and regulate a height of the slack of the upper run.

22. A compensating device in accordance with claim 21, wherein:

a drive is associated with one of the deflection points comprised of a deflecting roller to provide a driven deflecting roller; and the driven deflecting roller has a profiled jacket and the storage belt has a counter profiling for mutual positive-locking meshing.

23. A compensating device in accordance with claim 21, wherein a drive is associated with the fixed upper run deflection points as a discharge-side drive at the upper run and is controlled or regulated to a constant speed.

24. A compensating device in accordance with claim 23, wherein the discharge-side drive is controlled or regulated as a function of a preset speed value of the downstream, strengthening device.

25. A compensating device in accordance with claim 21, wherein a drive is associated with the fixed upper run deflection points as a feed-side drive at the upper run and is controlled to a variable speed.

26. A compensating device in accordance with claim 25, wherein the feed-side drive is controlled or regulated as a function of a preset speed value of the nonwoven laying device.

27. A plant for processing fibers, the plant comprising a compensating device for fluctuating conveying speeds of a fibrous nonwoven between plant components arranged between a feed side and a discharge side, the compensating device comprising:

an endless circulating driven storage belt;

a plurality of deflection points comprising two spaced apart fixed upper run deflection points defining a variable slack circulating driven belt upper run carrying the fibrous nonwoven, the plurality of deflection points further comprising two or more compensating deflection points defining lower taut belt runs between one of the compensating deflection points and one of the upper run deflection points, between another of the compensating deflection points and another of the upper run deflection points and between compensating deflection points for stretching the storage belt; and an adjusting device shifting at least one of the compensating deflection points for moving one of the compensating deflection points to change a spacing between two of the compensating deflection points, to change an amount of belt comprised by the lower taut belt runs and to compensate the variable slack circulating driven belt upper run of the storage belt.

28. A plant in accordance with claim 27, further comprising a nonwoven laying device and a strengthening device wherein the compensating device is arranged between the nonwoven laying device and the strengthening device, the strengthening device comprising a needle machine or a water jet strengthening device.

29. A method for compensating fluctuating conveying speeds of a fibrous nonwoven by means of a compensating device, the method comprising the steps of:

providing the compensating device such that the compensating device comprises:

an endless circulating driven storage belt; a plurality of deflection points comprising two spaced apart fixed upper run deflection points defining a variable slack circulating driven belt upper run carrying the fibrous nonwoven, and further comprising two or more compensating deflection points defining lower taut belt runs between one of the compensating deflection points and one of the upper run deflection points, between another of the compensating deflection points and another of the upper run deflection points and between compensating deflection points and with an adjusting device;

shifting at least one of the compensating deflection points for moving one of the compensating deflection points to change a spacing between two of the compensating deflection points, to change an amount of belt comprised by the lower taut belt runs and to compensate the variable slack circulating driven belt upper run of the storage belt.

30. A method in accordance with claim 29, wherein:

slack of the variable slack circulating driven belt upper run has a slack height that is controlled or regulated by differences in the speeds of the feed-side and discharge-side drives at the upper run provided by one or more drives associated with one of the deflection points comprised of a deflecting roller to provide a driven deflecting roller and the driven deflecting roller has a profiled jacket and the storage belt has a counterprofiling counter profiling for mutual positive-locking meshing; and the taut belt runs comprise a lower belt run area of the storage belt that is tightened by the shifting one of the deflection points.

31. A method in accordance with claim 29, wherein the slack has a slack height of the upper run that is controlled or regulated by the adjusting device and the shifting of the deflection point.

32. A method in accordance with claim 29, wherein the path of adjustment of one of the at least one deflection points is detected with a detection device and is used to regulate the slack height of the upper run.

* * * * *